US006753743B2

(12) United States Patent
Kondo

(10) Patent No.: US 6,753,743 B2
(45) Date of Patent: Jun. 22, 2004

(54) WAVEGUIDE FOR MICROWAVE DEVICE INCLUDING A FRAME WITH WAVEGUIDE GROOVES THEREIN

(75) Inventor: Hideki Kondo, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/068,432

(22) Filed: Feb. 6, 2002

(65) Prior Publication Data

US 2002/0113674 A1 Aug. 22, 2002

(30) Foreign Application Priority Data

Feb. 19, 2001 (JP) ..... 2001-042133

(51) Int. Cl.[7] ..... H01P 5/103
(52) U.S. Cl. ..... 333/26; 333/248
(58) Field of Search ..... 333/26, 134, 248

(56) References Cited

U.S. PATENT DOCUMENTS 2,574,790 A 11/1951 King
4,254,383 A * 3/1981 Wolfe ..... 333/161
4,608,713 A * 8/1986 Shiomi et al. ..... 455/325
4,777,654 A * 10/1988 Conti ..... 455/81
5,311,154 A * 5/1994 Hirota ..... 333/26
6,040,739 A 3/2000 Wedeen et al.

FOREIGN PATENT DOCUMENTS

| | | |
|---|---|---|
| CA | 2197909 | 9/1998 |
| JP | 53136939 | 11/1979 |
| JP | 07-15202 | 1/1995 |
| JP | 07-202520 | 8/1995 |

* cited by examiner

*Primary Examiner*—Benny Lee
(74) *Attorney, Agent, or Firm*—Brinks Hofer Gilson & Lione

(57) ABSTRACT

A first waveguide groove is formed in a sidewall of a main casing housing a first circuit board, and a second waveguide groove is formed in a sidewall of a sub-casing hermetically housing a second circuit board such that the first waveguide groove is in continuous connection with the second waveguide groove. Further, a lid is attached to the sidewall of the main casing so as to cover the first and the second waveguide grooves, and a probe provided on the second circuit board protrudes into the second waveguide groove. In addition, an inclined plane is formed at an end of the first waveguide groove so as to be in continuous connection with a through-hole provided in the lid.

11 Claims, 8 Drawing Sheets

WAVEGUIDE FOR MICROWAVE DEVICE INCLUDING A FRAME WITH WAVEGUIDE GROOVES THEREIN

BACKGROUND OF THE INVENTION

1. Field of the Invention

The present invention relates to a waveguide for a microwave device used as a satellite communication transmitter and the like.

2. Description of the Related Art

For example, a satellite communication transmitter as a microwave device is generally provided with a circuit board having a high-frequency circuit thereon. The high-frequency circuit includes an intermediate-frequency amplifier circuit, a local oscillator circuit, a hybrid power-amplifier circuit, and so forth. The circuit board is housed in a metal frame and capped by a cover plate. The intermediate-frequency amplifier circuit amplifies intermediate-frequency input signals to a certain power level. The hybrid power-amplifier circuit includes a frequency mixer as a frequency converter, a band-pass filter, and a power amplifier. The frequency mixer converts frequencies of the intermediate-frequency signals received from the intermediate-frequency amplifier circuit to predetermined high-frequencies in accordance with local oscillation signals received from the local oscillator circuit. Then, the band-pass filter allows the signals to pass through only when the converted frequencies lie in a predetermined frequency range. Subsequently, the power amplifier amplifies the signals passing through the band-pass filter to a sufficient degree of amplification so as to transmit the signals.

In such a satellite communication transmitter, the high frequency signals amplified by the hybrid power-amplifier circuit are transmitted into a waveguide via a probe, and then are emitted into air via a horn at an end of the waveguide. A known structure of the waveguide is such that the end of the probe protrudes from a side surface of the frame and also the waveguide, which is integrally molded by, e.g., aluminum die-casting, is fixed to the side surface of the frame in order that the end of the probe is inserted in the waveguide.

However, in the aforementioned known art, fixing the integrally molded waveguide to the frame of the microwave device substantially reduces the space for mounting components of the device due to the required waveguide length, and also bringing the end of the opening of the waveguide into line with the probe substantially limits the layout design freedom of the components including the waveguide.

SUMMARY OF THE INVENTION

In view of the aforementioned known art, it is an object of the present invention to provide a waveguide for a microwave device, which provides sufficient space for mounting device components and enhanced layout design freedom for the components.

To this end, a waveguide for a microwave device according to the present invention comprises a frame for housing a high-frequency circuit therein, and a lid attached to a sidewall of the frame, wherein at least one of the frame and the lid has a waveguide groove formed therein and extending along the mating surface between the frame and the lid.

In the waveguide configured as described above, the lid is attached to the sidewall of the frame and covers the waveguide groove formed at least one of the frame and the lid so as to function as a waveguide, thereby providing sufficient space for device components and improved layout design freedom for the components.

In the above configuration, the frame may comprise a main casing housing a first circuit board and a sub-casing housing a second circuit board, and the second circuit board may have a probe provided thereon such that the probe protrudes into the waveguide groove. This arrangement makes sure to shield circuit components including a probe mounted on the second circuit board and other circuits components mounted on the first circuit board.

Further, in the above configuration, the lid may have a projected flange formed thereon so as to serve as a fixing surface for a mating waveguide, and the flange may have a waveguide through-hole therein so that the waveguide groove is in continuous connection with the waveguide through-hole via an inclined plane formed at an end of the waveguide groove. This arrangement reduces the proportion of the surface area of the flange relative to the overall outer surface area of the lid, and makes it easy to obtain the flat end surface of the flange, thus allowing the mating waveguide to be accurately mounted on the end surface of the flange of the lid.

Furthermore, in the above configuration, the sub-casing is preferably arranged inside the four sidewalls of the main casing and the main casing preferably has a through-hole formed in the sidewall to which the lid is attached so that the probe penetrates through the through-hole.

Alternatively, the main casing may have a cut-out formed in the sidewall to which the lid is attached and the sub-casing arranged inside the main casing may have a sidewall which is exposed at the cut-out. In this arrangement, both the main casing and the sub-casing preferably have waveguide grooves formed in the respective sidewalls, and the lid preferably has a flat surface to cover the waveguide grooves.

DESCRIPTION OF THE PREFERRED EMBODIMENTS

Figure 1:
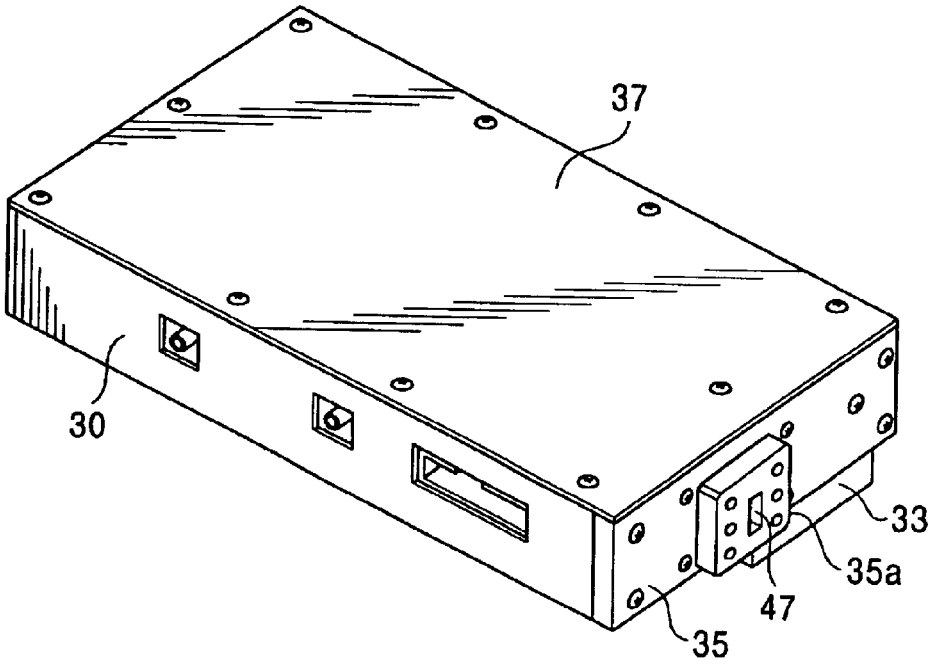
FIG. 1 is a perspective view illustrating the entire structure of an electronic circuit unit according to an embodiment of the present invention.

Referring now to the accompanying drawings, embodiments of the present invention will be described in which the same reference numerals in different drawing figures refer to the same feature and may not be described in detail for all drawing figures.

Figure 10:
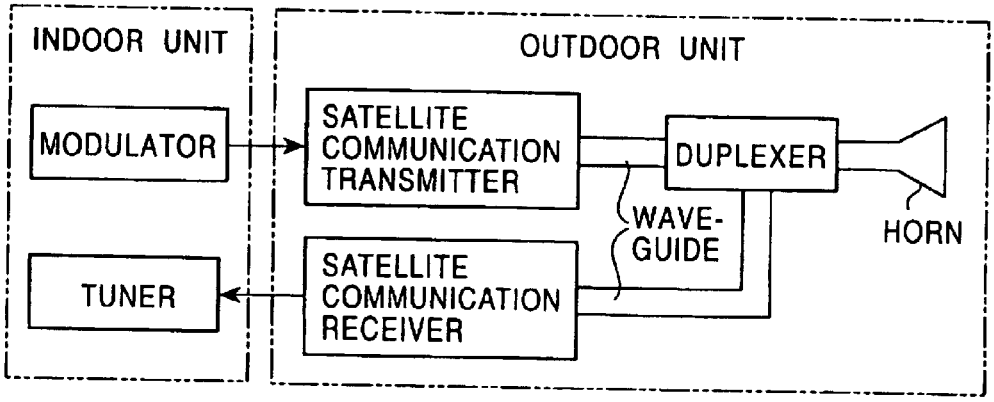
FIG. 10 is an illustration of the entire configuration of a satellite communication system including the electronic circuit unit.

An application of an electronic circuit unit according to embodiments of the present invention is a satellite communication transmitter (i.e., a microwave device) used for a satellite communication system. As shown in FIG. 10, the satellite communication system comprises an indoor unit housing a modulator, a tuner, etc., and an outdoor unit housing a satellite communication transmitter, a satellite communication receiver, a duplexer, a horn, etc. In such a satellite communication system, the satellite communication transmitter converts frequencies of intermediate-frequency signals received from the modulator to predetermined high frequencies and amplifies the frequency-converted signals so as to transmit the amplified high-frequency signals to a satellite through a waveguide, the duplexer, and the horn in that order. In the meantime, the satellite communication receiver receives signals from the satellite via the horn, the duplexer, and another waveguide in that order, and transmits them to the tuner in the indoor unit.

Figure 11:
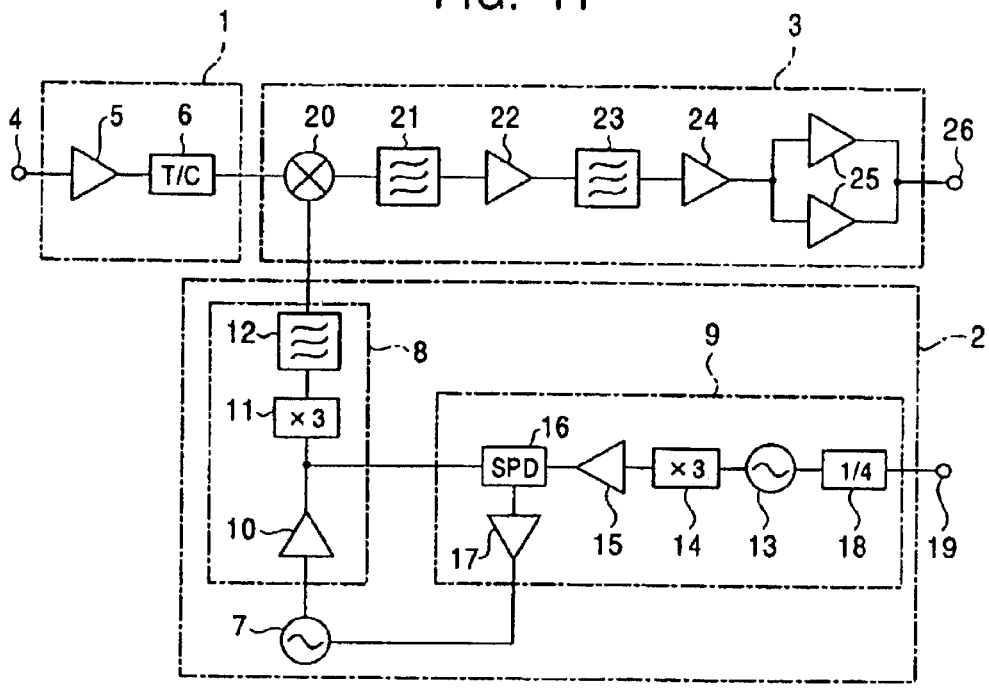
FIG. 11 is an illustration of the circuit configuration of the electronic circuit unit.

As shown in FIG. 11, the satellite communication transmitter comprises an intermediate-frequency amplifier circuit 1, a local oscillator circuit 2, and a hybrid power-amplifier circuit 3.

The intermediate-frequency amplifier circuit 1 comprises an amplifier 5 and a thermal compensator (T/C) 6. The intermediate-frequency amplifier circuit 1 receives signals with intermediate frequencies ranging from 2.5 to 3 GHz via an input terminal 4 of the modulator in the indoor unit. The amplifier 5 amplifies the intermediate-frequency signals to a certain power level and transmits the signals to the hybrid power-amplifier circuit 3 via the thermal compensator 6. The thermal compensator 6 compensates for variations in the amplification of the amplifier 5 caused by varying ambient temperature. More particularly, the thermal compensator 6 amplifies the intermediate-frequency signals when an elevated ambient temperature causes the amplifier 5 to reduce the amplification on one hand, and attenuates the intermediate-frequency signals when a lower ambient temperature causes the amplifier 5 to increase the amplification on the other hand. That is to say, the thermal compensator 6 transmits the intermediate-frequency signals lying at a substantially predetermined signal level to the hybrid power-amplifier circuit 3 when the ambient temperature varies in any way.

The local oscillator circuit 2 comprises a voltage-controlled oscillator (VCO) 7, an oscillation-signal amplifier circuit 8, and a reference-oscillation circuit 9. The oscillation-signal amplifier circuit 8 comprises an amplifier 10, a times-three frequency multiplier 11, and a band-pass filter 12. The reference-oscillation circuit 9 comprises a reference oscillator 13, a times-three (×3) frequency multiplier 14, an amplifier 15, a sampling phase detector (SPD) 16, an amplifier 17, and a divide-by-four frequency (1/4) divider 18.

The voltage-controlled oscillator 7 generates oscillation signals with a 9 GHz frequency and transmits them to the amplifier 10. The amplifier 10 converts the 9 GHz frequency of the received oscillation signals to a frequency of 27 GHz at the times-three frequency multiplier 11, and transmits the converted signals to the hybrid power-amplifier circuit 3 via the band-pass filter 12 which permits only oscillation signals with a 27 GHz frequency to pass through.

Meanwhile, in the reference-oscillation circuit 9, the reference oscillator 13 generates oscillation signals with a 40 MHz frequency, then the times-three frequency multiplier 14 converts the 40 MHz frequency to a frequency of 120 MHz, and subsequently the amplifier 15 amplifies the signals and transmits them to the sampling phase detector 16. The sampling phase detector 16 receives two kinds of oscillation signals, i.e., one with a 120 MHz frequency amplified at the amplifier 15, the other with a 9 GHz frequency generated at the voltage-controlled oscillator 7 and amplified at the amplifier 10, and produces phase-comparison error signals due to the phase difference between these two kinds of signals. That is to say, a closed loop consisting of the voltage-controlled oscillator 7, the amplifier 10, the sampling phase detector 16, and the amplifier 17 serves as a phase-locked loop (hereinafter, referred to as PLL). Since the PIL allows the voltage-controlled oscillator 7 to generate signals with a frequency of 9 GHz reliably, the amplifier 10 amplifies the oscillation signals with a frequency of 9 GHz received from the voltage-controlled oscillator 7 and transmits them to the times-three frequency multiplier 11 as described above.

The divide-by-four frequency divider 18 converts the 40 MHz frequency of a part of the reference-oscillation signals generated at the reference oscillator 13 to a frequency of 10 MHz and transmits the converted signals to external circuits (not shown) via a signal output terminal 19 so that the signals serve as reference signals for the external circuits.

The hybrid power-amplifier circuit 3 comprises a frequency converter 20 (i.e., a frequency mixer), a band-pass filter 21, a power amplifier 22, a band-pass filter 23, a power amplifier 24, and a pair of power amplifiers 25 connected in parallel.

In the hybrid power-amplifier circuit 3, upon receiving two kinds of signals, one being the intermediate-frequency signals with frequencies ranging from 2.5 to 3 GHz received from the thermal compensator 6 of the intermediate-frequency amplifier circuit 1, and the other being the oscillation signals with a frequency of 27 GHz received from the band-pass filter 12 of the local oscillator circuit 2, the frequency converter 20 mixes these two kinds of signals to produce high frequency signals with frequencies ranging from 29.5 to 30 GHz. Then, the band-pass filter 21 allows any of the signals received from the frequency converter 20 to pass through as long as they lie in a desirable frequency range. Following this, the power amplifier 22 amplifies the signals received from the band-pass filter 21. Further, the band-pass filter 23 allows any of the signals received from the power amplifier 22 to pass through as long as they lie in a desirable frequency range. Subsequently, the power amplifier 24 amplifies the high frequency signals received from the band-pass filter 23 to a certain high-frequency power level. Finally, the pair of power amplifiers 25 connected in parallel further amplify the signals amplified at the amplifier 24 to a power level sufficient to be emitted into the air and transmits the further amplified signals to the waveguide via an output terminal 26 (i.e., a probe).

Figure 2:
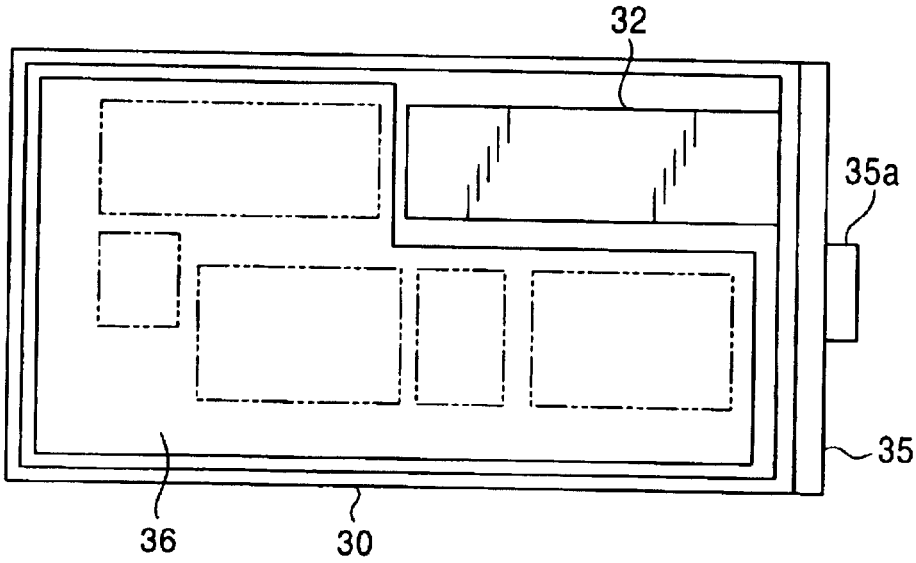
FIG. 2 is a plan view of the inner structure of the electronic circuit unit.
Figure 3:
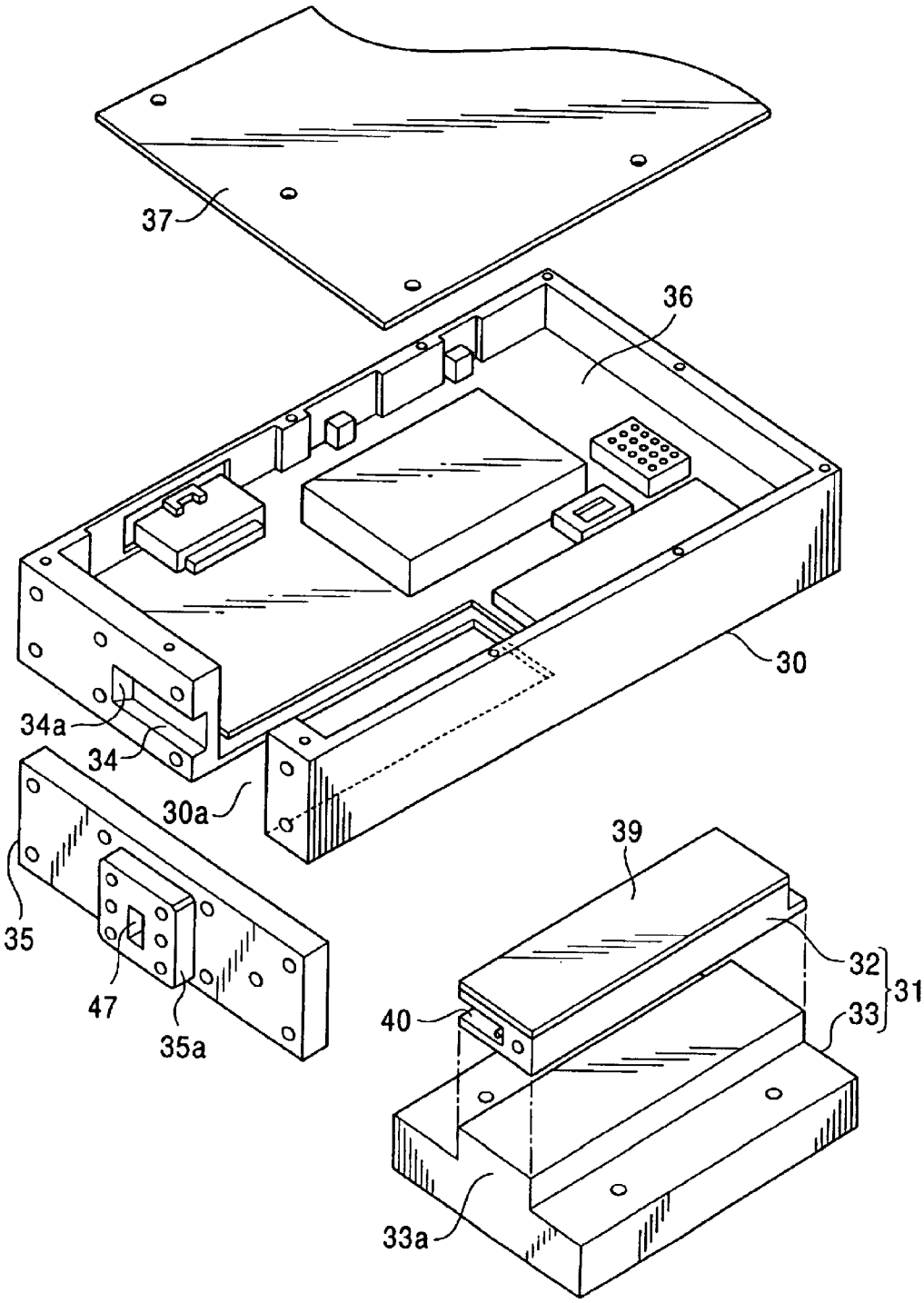
FIG. 3 is an exploded perspective view of the electronic circuit unit.

The electronic circuit unit according to the embodiments is used as a satellite communication transmitter having the above described circuit configuration. As shown in FIGS. 1 to 3, the electronic circuit unit comprises an aluminum die-cast main casing 30 constituting a frame, and a radiator 31 (FIG. 3). The radiator 31 comprises a sub-casing 32 and a radiation plate 33, which are integrally bonded to each other as shown in FIG. 3.

The main casing 30 has an almost whole bottom and no top formed by aluminum die-casting. The main casing 30 has an aluminum die-cast first waveguide groove 34 formed in the outer surface of a sidewall thereof and an opening 30*a* extending from the aforementioned sidewall to the bottom as shown in FIG. 3. Further, the main casing 30 has a lid 35 formed by aluminum die-casting and screwed to the outer surface of the sidewall thereof so as to cover the first waveguide groove 34. The main casing 30 has a first circuit board 36 (see FIGS. 2, 3) disposed therein. The first circuit board 36 has a cut-out at a corner thereof shaped so as to match the shape of the opening 30*a*. The first circuit board 36 has the circuit components of the intermediate-frequency amplifier circuit 1 and the local oscillator circuit 2 shown in FIG. 11 mounted thereon, but excluding those of the hybrid power-amplifier circuit 3. The main casing 30 has a cover plate 37 (see FIGS. 1, 3) screwed to the top ends of the four sidewalls thereof so as to cover the open top thereof.

Figure 4:
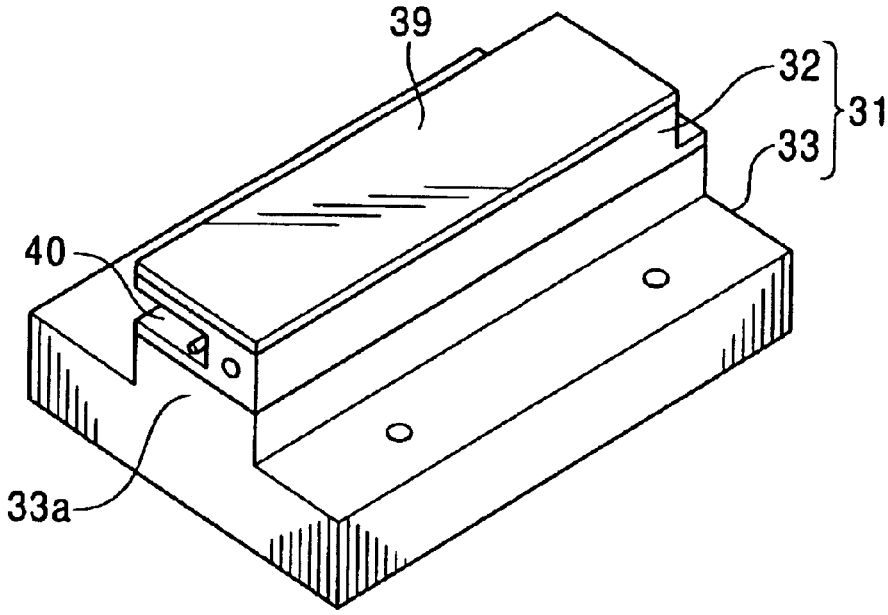
FIG. 4 is a perspective view of a radiator of the electronic circuit unit.
Figure 5:
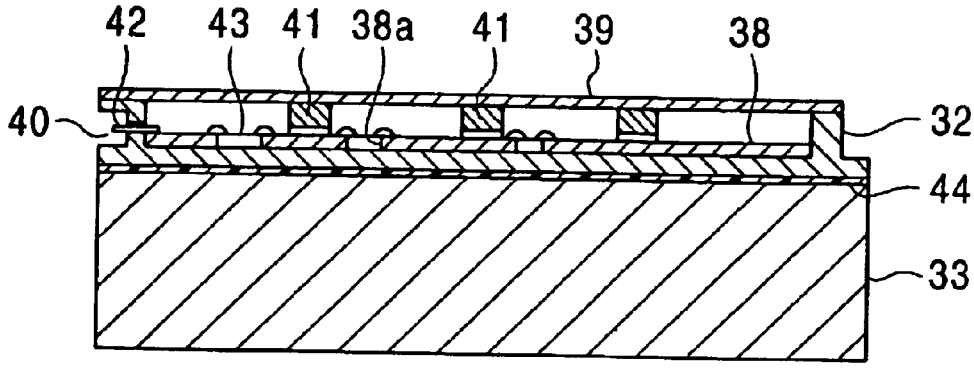
FIG. 5 is a sectional view of the inner structure of the radiator.
Figure 6:
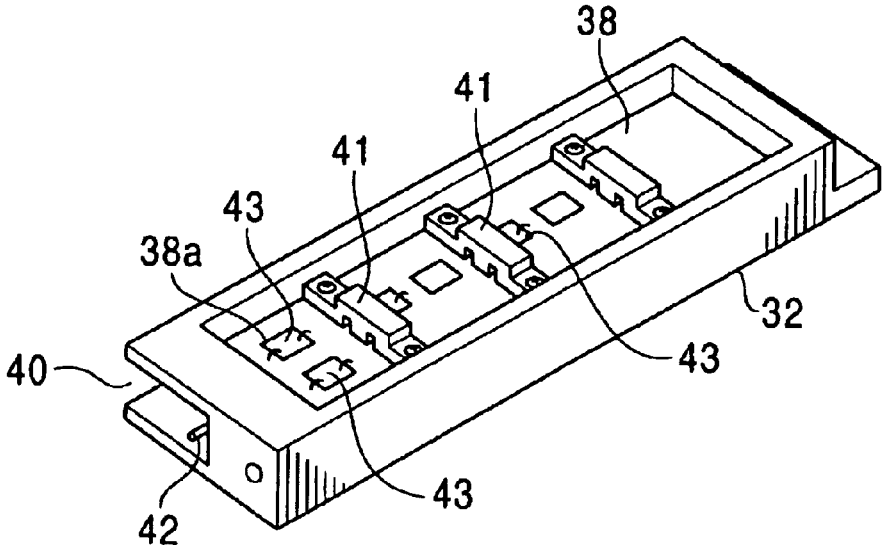
FIG. 6 is a perspective view of the inner structure of a sub-casing of the electronic circuit unit.

As shown in FIGS. 4 to 6, the sub-casing 32 is formed to have a bottom and no top, and has a second circuit board 38 (see FIGS. 5, 6) disposed therein. The sub-casing 32 has a cover plate 39 (see FIGS. 4, 5) attached on the open top thereof so as to tightly seal the inside thereof. The sub-casing 32 has a second waveguide groove 40 formed in the outer surface of a sidewall thereof. The sub-casing 32 and the cover plate 39 are formed of copper, which has a larger thermal conductivity than aluminum which is used for the main casing 30, and have a corrosion-resistant gold plating provided on the surfaces thereof. The second circuit board 38 has the hybrid power-amplifier 3 of the circuit configuration shown in FIG. 11 mounted thereon. The sub-casing 32 and the cover plate 39 define two circuits, i.e., the combination of the intermediate-frequency amplifier circuit 1 and the local oscillator circuit 2, which are mounted on the first circuit board 36, and the hybrid power-amplifier circuit 3 mounted on the second circuit board 38 in the main casing 30.

The second circuit board 38 is fixed to the inner bottom surface of the sub-casing 32 by screwing a plurality of metal fixing members 41 (see FIGS. 5, 6). The fixing members 41 divide the second circuit board 38 into a plurality of areas. Although not shown in the drawings, the frequency converter 20 and the band-pass filters 21 and 23 among the circuit components of the hybrid power-amplifier circuit 3 of FIG. 11 are each mounted on the corresponding areas of the second circuit board 38. A probe 42 (see FIGS. 5, 6) as the output terminal 26 of FIG. 11 protrudes into the second waveguide groove 40 of the sub-casing 32 from one end of the second circuit board 38. Because of the requirement for providing a large amplification all the other circuit components, i.e., the power amplifiers 22, 24 and 25 of FIG. 11, comprise bare semiconductor chips 43 as shown in FIGS. 5, 6. These bare semiconductor chips 43 are inserted in the corresponding through-holes 38*a* provided in the second circuit board 38, are bonded to the inner bottom surface of the sub-casing 32 with a conductive adhesive, and are connected to a conductive pattern (not shown) on the second circuit board 38 by wire bonding as shown in FIGS. 5, 6.

Figure 7:
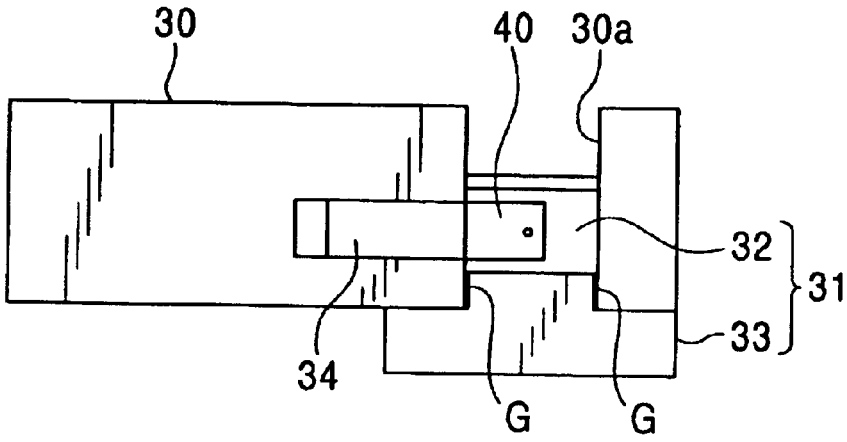
FIG. 7 is an illustration of mounting the radiator in a main casing of the electronic circuit unit.
Figure 8:
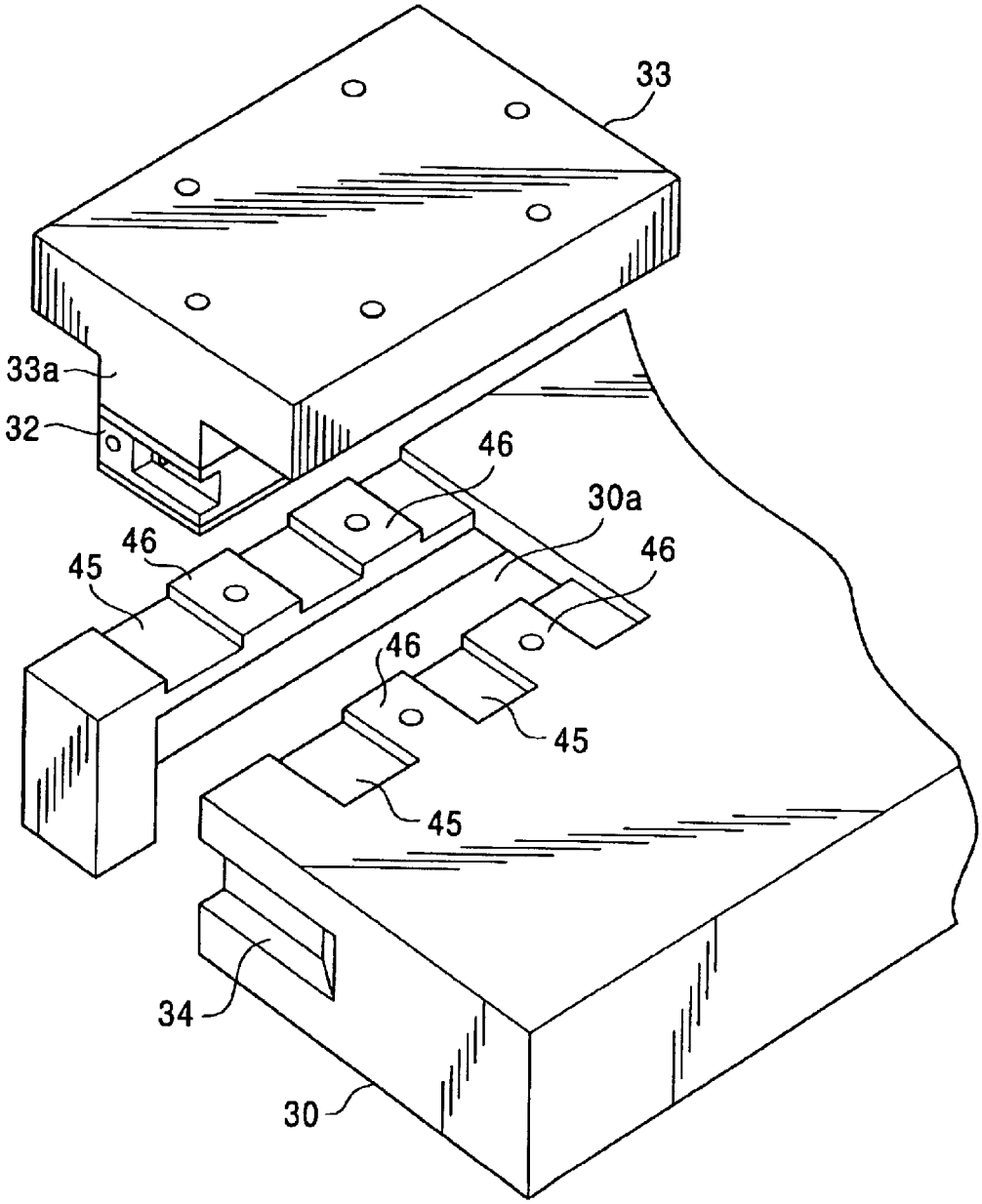
FIG. 8 is an exploded perspective bottom view of the part where the radiator is mounted to the main casing.

The radiation plate 33 (see FIGS. 4, 5) has a protrusion 33*a* (see FIG. 4), the width of which is formed slightly smaller than that of the opening 30*a* of the main casing 30. The sub-casing 32 and the radiation plate 33 are integrally bonded at the bottom of the sub-casing 32 and the top of the protrusion 33*a*, a radiation sheet 44 being interposed therebetween, thus forming the unified radiator 31 (see FIG. 4) as described above. The adhesive radiation sheet 44 (see FIG. 5) composed of, e.g., a silicone based resin, smoothes fine irregularities on the contact surface between the sub-casing 32 and the radiation plate 33. As shown in FIG. 7, while being inserted into the opening 30*a*, the radiator 31 is screwed to the bottom of the main casing 30 such that slight gaps G are maintained between the sidewalls of the protrusion 33*a* of the radiation plate 33 and those of the opening 30*a* of the main casing 30 in order that the protrusion 33*a* of the radiation plate 33 does not come into contact with the main casing 30. Further, as shown in FIG. 8, the main casing 30 has pluralities of depressions 45 and projections 46 which are alternately formed on the bottom of the main casing 30 with the opening 30*a* interposing therebetween. The projections 46 serve as contact surfaces between the bottom of the main casing 30 and the radiation plate 33 so as to join the main casing 30 and the radiation plate 33. The depressions 45, each being placed between adjacent projections 46, reduce the contact area between the bottom of the main casing 30 and the radiation plate 33, thereby reducing the amount of heat transfer from the radiation plate 33 to the main casing 30.

Figure 9:
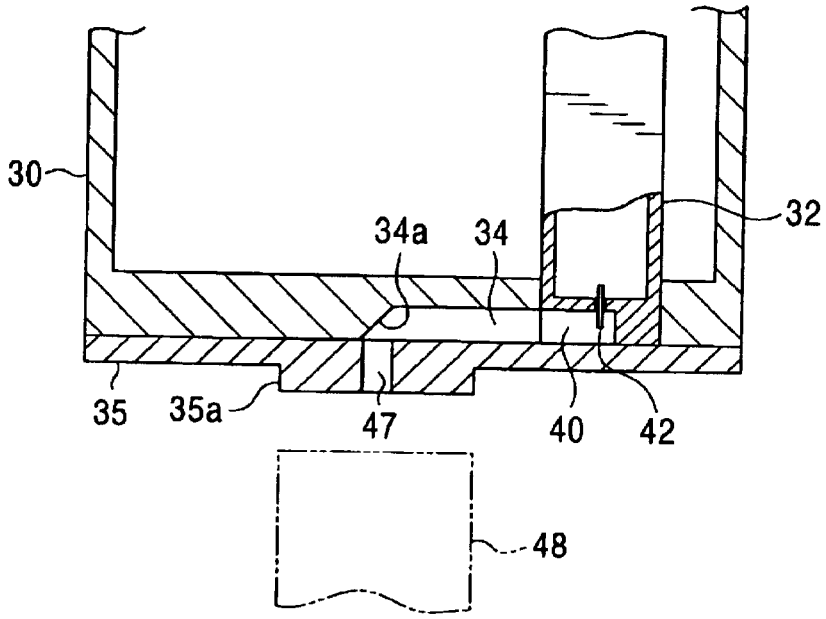
FIG. 9 is a sectional view of waveguides of the electronic circuit unit.

As shown in FIG. 9, the lid 35 has an outwardly projected flange 35*a* integrally formed on the outer surface thereof and a waveguide through-hole 47 penetrating the flange 35*a*. The lid 35 is attached to the outer surface of the sidewall of the main casing 30 so as to cover the side of the opening 30*a* and is screwed to the sub-casing 32, which is exposed at the opening 30*a*, and to the main casing 30. With this configuration, the inner flat surface of the lid 35 covers the first waveguide groove 34 of the main casing 30 and the second waveguide groove 40 of the sub-casing 32, thus allowing the first waveguide groove 34, the second waveguide groove 40, and the lid 35 to form a waveguide. The first waveguide groove 34 has an inclined plane 34*a* formed at an end of the waveguide at an angle of about 45° with respect to the longitudinal center line of the waveguide so as to be in continuous connection with the waveguide through-hole 47 of the lid 35 in the vicinity of the inclined plane 34*a*. Accordingly, high-frequency output signals at the probe 42 of the hybrid power-amplifier circuit 3 of FIG. 11 travel in the second waveguide groove 40 and the first waveguide groove 34, are reflected at the inclined plane 34*a*, pass through the waveguide through-hole 47, and are emitted from the flange 35*a* of the lid 35 in that order. Further, a mating waveguide 48, indicated by the two-dot chain line in FIG. 9, is mounted on the end surface of the flange 35*a*. The waveguide 48 is connected to the duplexer as above described (refer to FIG. 10).

In such a configuration of the electronic circuit unit (i.e., the microwave device), the lid 35 is screwed to the sidewall of the main casing 30 housing the high-frequency circuit so as to form a waveguide in the mating surface between the main casing 30 and the lid 35 by covering the first waveguide groove 34 and the second wave guide groove 40 formed in the respective sidewalls of the main casing 30 and the sub-casing 32, with the flat surface of the lid 35. This configuration not only provides a compact waveguide in the mating surface between the main casing 30 and the lid 35, but also allows the waveguide to be arranged freely as long as the waveguide is connected to the probe 42, thereby providing sufficient space for components of the electronic circuit unit and enhanced layout design freedom of the components.

Also, the circuit components of the intermediate-frequency amplifier circuit 1 and the local oscillator circuit 2 of FIG. 11 are mounted on the first circuit board 36 disposed in the main casing 30 as shown in FIG. 2, the circuit components of the hybrid power-amplifier circuit 3 of FIG. 11 are mounted on the second circuit board 38 hermetically disposed in the sub-casing 32 as shown in FIG. 2, and additionally the probe 42 provided on the second circuit board 38 protrudes into the second waveguide groove 40 as shown in FIG. 9. With this configuration, the hybrid power-amplifier circuit 3 is shielded against the intermediate-frequency amplifier circuit 1 and the local oscillator circuit 2 in the main casing 30. Accordingly, high-frequency signals transmitted from the hybrid power-amplifier circuit 3 are unlikely to leak into another circuit even when the frequencies used for the satellite communication system become higher, e.g., up to about 30 GHz, thereby preventing fluctuation of the output of the hybrid power-amplifier circuit 3.

Further, the outwardly projected flange 35*a* is formed on the outer surface of the lid 35, and the waveguide through-hole 47 is provided in the flange 35*a* so as to be in continuous connection with the inclined plane 34*a* at an end of the first waveguide groove 34, thereby reducing the proportion of the area of the flange 35*a* with respect to the overall outer surface area of the lid 35. This configuration makes it easy to obtain the flat end surface of the flange 35*a*, thus allowing the mating waveguide 48 to be accurately mounted on the end surface of the flange 35*a*.

Figure 12:
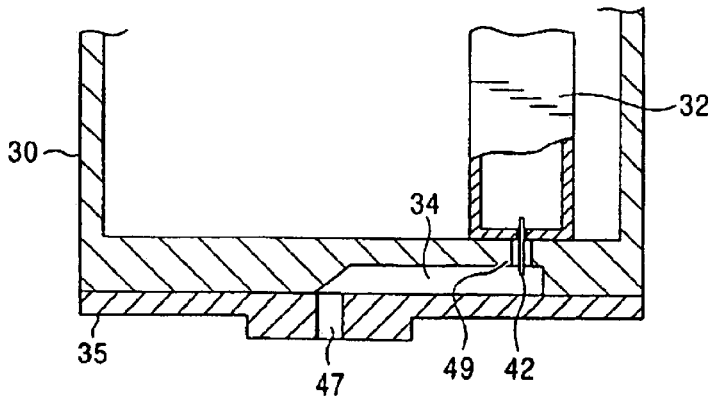
FIG. 12 is an illustration of a modification of the waveguide.

The present invention is not limited to the above described embodiment, but can undergo a variety of modifications. In an exemplary modification as shown in FIG. 12, only the first waveguide groove 34 is provided in the sidewall of the main casing 30 by omitting the second waveguide groove 40, the sub-casing 32 is arranged inside the four sidewalls of the main casing 30, and further the probe 42 of the sub-casing 32 protrudes into the first waveguide groove 34 from a through-hole 49 penetrating the sidewall of the main casing 30. Alternatively, waveguide grooves may be disposed in the inner surface of the lid 35 instead of being disposed in the main casing 30 and the sub-casing 32, and this lid 35 may be attached to flat sidewalls of the main casing 30 and the sub-casing 32.

The present invention is effected according to the embodiments as described above and offers the following advantages.

An electronic circuit unit according to the present invention is configured such that a lid is attached to a sidewall of the frame housing a high-frequency circuit therein, allowing a waveguide groove provided in the mating surface between the frame and the lid to serve as a waveguide. Accordingly, this configuration provides sufficient space for mounting circuit components of the electronic circuit unit and enhanced layout design freedom of the components.

What is claimed is:

1. A waveguide for a microwave device, comprising:

a frame housing a high-frequency circuit therein, the frame comprising a main casing housing a first circuit board and a sub-casing housing a second circuit board; and a lid attached to a sidewall of the frame, wherein the main casing has a cut-out formed in the sidewall to which the lid is attached, the sub-casing arranged inside the main casing has a sidewall which is exposed at the cut-out, both the main casing and the sub-casing have waveguide grooves formed in the respective sidewalls, the waveguide grooves extend along a mating surface between the frame and the lid, the lid has a flat surface to cover the waveguide grooves, and the second circuit board has a probe provided thereon, the probe protruding into the waveguide groove of the sub-casing.

2. The waveguide according to claim 1, wherein the lid has a projected flange formed thereon so as to serve as a fixing surface for a mating waveguide, and the flange has a waveguide through-hole therein so that the waveguide groove is in continuous connection with the waveguide through-hole via an inclined plane formed at an end of the waveguide groove.

3. The waveguide according to claim 1, further comprising through-holes provided in the second circuit board, the through-holes having sufficient size to permit bare semiconductor chips to be inserted therein.

4. The waveguide according to claim 3, wherein the bare semiconductor chips are bonded to an inner bottom surface of the sub-casing through conductive adhesive and are connected to a conductive pattern on the second circuit board through wire bonds.

5. The waveguide according to claim 1, further comprising a radiation plate on which the sub-casing is disposed.

6. The waveguide according to claim 5, further comprising an adhesive radiation sheet interposed between the sub-casing and the radiation plate, and the adhesive radiation sheet smoothing fine irregularities on a contact surface between the sub-casing and the radiation plate.

7. The waveguide according to claim 1, wherein the main casing has an opening with an end that defines the cut-out, the sub-casing disposed in the opening such that the sub-casing does not contact the main casing within the opening.

8. The waveguide according to claim 5, wherein the main casing has an opening with an end that defines the cut-out, the radiation plate has a protrusion disposed in the opening such that the protrusion does not contact the main casing.

9. The waveguide according to claim 8, wherein the main casing has alternating depressions and projections formed on both sides of the opening, the projections serve as contact surfaces between the main casing and the radiation plate so as to join the main casing and the radiation plate and the depressions reduce the contact area between the main casing and the radiation plate.

10. The waveguide according to claim 1, wherein the lid has a hole that connects the waveguide grooves in the main and sub-casings with an external element to receive signals propagating through the waveguide grooves and hole.

11. The waveguide according to claim 1, wherein the second circuit board is electromagnetically shielded on all sides from the first circuit board.

* * * * *